US008846144B1

(12) United States Patent
Wang et al.

(10) Patent No.: US 8,846,144 B1
(45) Date of Patent: Sep. 30, 2014

(54) METHOD FOR MAKING A CARBON NANOTUBE FILM

(75) Inventors: Ding Wang, Beijing (CN); Peng-Cheng Song, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 1711 days.

(21) Appl. No.: 12/004,671

(22) Filed: Dec. 20, 2007

(30) Foreign Application Priority Data

Apr. 13, 2007 (CN) ..... 2007 1 0074026

(51) Int. Cl.
*B05D 5/12* (2006.01)
*D01F 9/12* (2006.01)
*H01B 1/04* (2006.01)

(52) U.S. Cl.
USPC ..... 427/217; 423/447.1; 977/745; 252/514

(58) Field of Classification Search
USPC ..... 252/510, 512, 514; 423/447.1, 447.3, 423/460, 461; 977/842, 843, 845, 847, 888; 427/217
See application file for complete search history.

(56) References Cited

U.S. PATENT DOCUMENTS

| | | | | |
|---|---|---|---|---|
| 6,616,495 | B1 | 9/2003 | Tsuboi | |
| 6,790,425 | B1 * | 9/2004 | Smalley et al. | 423/447.1 |
| 7,858,185 | B2 | 12/2010 | Sen et al. | |
| 2003/0170166 | A1 * | 9/2003 | Smalley et al. | 423/447.1 |
| 2004/0047038 | A1 * | 3/2004 | Jiang et al. | 359/486 |
| 2004/0048365 | A1 * | 3/2004 | Huie et al. | 435/293.1 |
| 2004/0105807 | A1 * | 6/2004 | Fan et al. | 423/447.3 |
| 2004/0191158 | A1 * | 9/2004 | Liu et al. | 423/447.3 |
| 2004/0197638 | A1 * | 10/2004 | McElrath et al. | 429/44 |
| 2004/0209815 | A1 * | 10/2004 | Shirley et al. | 514/12 |
| 2006/0035084 | A1 * | 2/2006 | Liu et al. | 428/408 |
| 2006/0090598 | A1 * | 5/2006 | Goia et al. | 75/371 |
| 2006/0225163 | A1 * | 10/2006 | Wei et al. | 977/840 |

FOREIGN PATENT DOCUMENTS

| | | |
|---|---|---|
| CN | 1475437 A | 2/2004 |
| CN | 1699283 A | 11/2005 |
| TW | 200508601 | 3/2005 |
| TW | 200600452 | 1/2006 |
| TW | 200618857 | 6/2006 |
| TW | 200714361 | 4/2007 |

OTHER PUBLICATIONS

Satishkumar, et al., The decoration of carbon nanotubes by metal nanoparticles, J. Phys. D.: Appl. Phys. 1996; 29: 3173-3176.*
Li et al.,Preparation and Characterization of Multiwalled Carbon Nanotube-Supported Platinum for Cathode Catalysts of Direct Methanol Fuel Cells, J.Phys.Chem.B,Jun. 6, 2003,pp. 6292-6299,vol. 107,No. 26.

* cited by examiner

*Primary Examiner* — Daniel C McCracken
(74) *Attorney, Agent, or Firm* — Novak Druce Connolly Bove + Quigg LLP

(57) ABSTRACT

A method for making a carbon nanotube film includes the steps of: (a) adding a plurality of carbon nanotubes into a solvent containing metallic ions, and flocculating the carbon nanotubes to get a floccule structure with the metallic ions therein; (b) reducing the metallic ions into metallic atoms, thereby the metallic atoms being attached onto outer surfaces of the carbon nanotubes to form a floccule structure of carbon nanotubes compounded with metal atoms; and (c) separating the floccule structure compounded with metal atoms from the solvent; and (d) shaping the floccule structure compounded with metal atoms to obtain/get the carbon nanotube film.

11 Claims, 3 Drawing Sheets

METHOD FOR MAKING A CARBON NANOTUBE FILM

RELATED APPLICATIONS

This application is related to a commonly-assigned application Ser. No. 12/004,673 entitled, "METHOD FOR MAKING A CARBON NANOTUBE FILM", filed Dec. 20, 2007. Disclosure of the above-identified application is incorporated herein by reference.

BACKGROUND

1. Field of the Invention

The invention relates generally to carbon nanotube films and, particularly, to a method for making a metal doped carbon nanotube film.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs are electrically conductive along their length, chemically stable, and capable, individually, of having a very small diameter (much less than 100 nanometers) and large aspect ratios (length/diameter). Due to these and other properties, it has been suggested that CNTs can play an important role in various fields, such as field emission devices, new optic materials, sensors, soft ferromagnetic materials, etc.

Carbon nanotube film has been found especially useful in field emission electron sources, photoelectric and biological sensors, transparent electrical conductors, battery electrodes, absorbing materials, water purification materials, light emitting material, and related devices. As a result of rapid development of fabrication technology of carbon nanotube film, metal and carbon nanotubes are now compounded to form a carbon nanotube film, which is beneficial to exploit the electricity conductivity and the thermal conductivity of the carbon nanotubes therein.

A fabrication method of the carbon nanotube film with metal is generally as follows. Firstly, a carbon nanotube film is prepared in advance. Secondly, metal is spray filled and/or evaporated filled into gaps in the carbon nanotube film to form the carbon nanotube film with carbon nanotube and metal compound. However, the above-described methods generally have complicated fabrication procedures. Thus, in use, such methods have proven less efficient than truly desirable. Furthermore, the carbon nanotube film produced by the above-described methods has the problems, such as a small ratio of metal and the metal unevenly dispersed in the carbon nanotube film.

What is needed, therefore, is a method for making a carbon nanotube film from a carbon nanotube and metal compound, which is very simple and efficient in producing the film and has a controllable ratio of metal uniformly dispersed therein.

SUMMARY

A method for making a carbon nanotube film includes the steps of: (a) adding a plurality of carbon nanotubes into a solvent containing metallic ions, and flocculating the carbon nanotubes to get a floccule structure of carbon nanotube with the metallic ions dispersed therein; (b) reducing the metallic ions into metallic atoms, thereby the metallic atoms being attached onto outer surfaces of the carbon nanotubes to form the floccule structure of carbon nanotubes compounded with metal atoms; (c) separating the floccule structure compounded with metal atoms from the solvent; and (d) shaping the floccule structure compounded with metal atoms to obtain a carbon nanotube film.

Other advantages and novel features of the present method for making a carbon nanotube film will become more apparent from the following detailed description of presents embodiments when taken in conjunction with the accompanying drawings.

BRIEF DESCRIPTION OF THE DRAWINGS

Many aspects of the present method for making a carbon nanotube film can be better understood with reference to the following drawings. The components in the drawings are not necessarily to scale, the emphasis instead being placed upon clearly illustrating the principles of the present method for making a carbon nanotube film.

Figure 1:
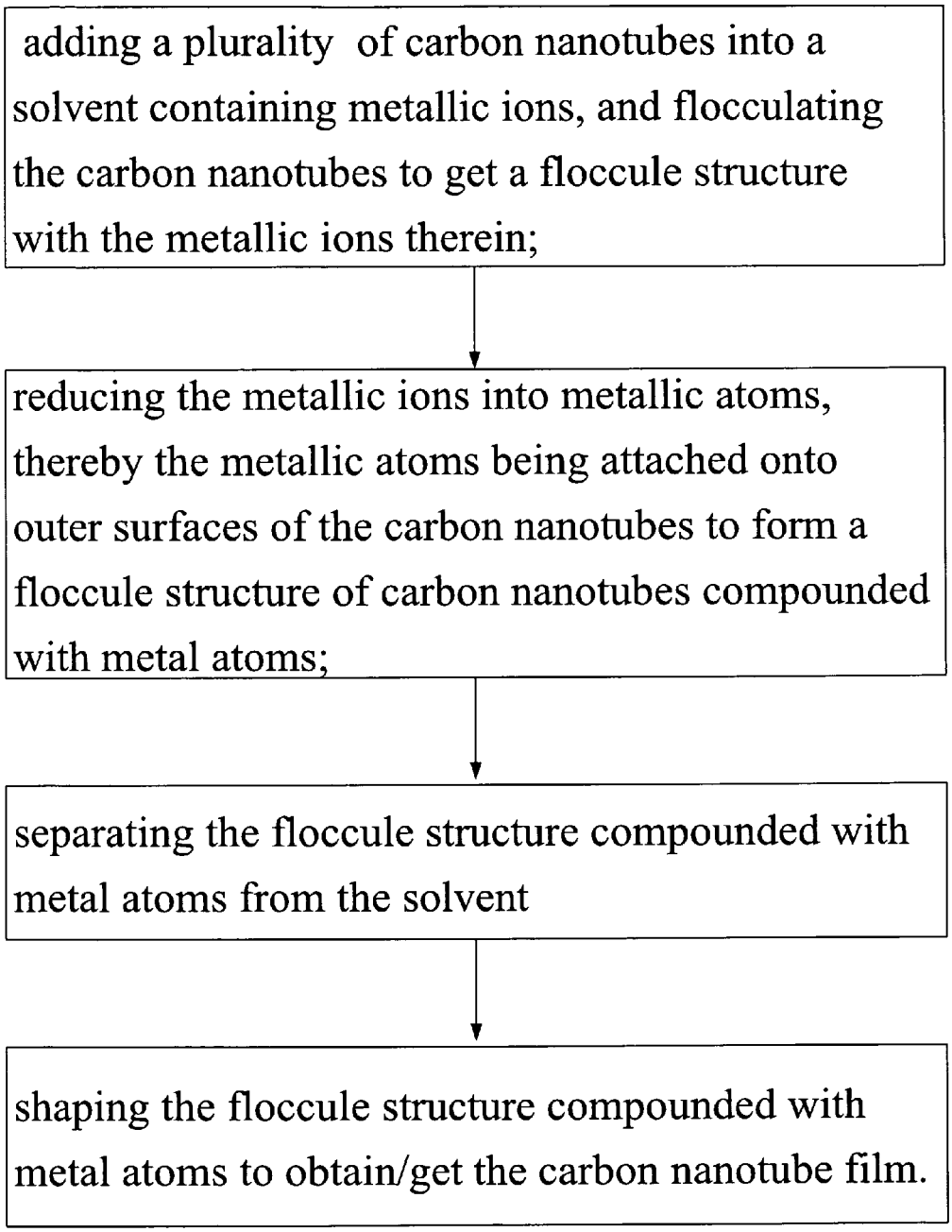
FIG. 1 is a flow chart of a method for making a carbon nanotube film, in accordance with a present embodiment.

Corresponding reference characters indicate corresponding parts throughout the several views. The exemplifications set out herein illustrate at least one preferred embodiment of the present method for making a carbon nanotube film, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present method for making a carbon nanotube film.

Referring to FIG. 1, a method for making/producing a carbon nanotube film includes the following steps: (a) adding a plurality of carbon nanotubes into a solvent including metallic ions, and flocculating the carbon nanotubes to get a floccule structure with the metallic ions dispersed therein; (b) reducing the metallic ions into metallic atoms, thereby the metallic atoms being attached onto outer surfaces of the carbon nanotubes to form a floccule structure of carbon nanotubes compounded with metal atoms; (c) separating the floccule structure compounded with metal atoms from the solvent; and shaping the floccule structure compounded with metal atoms to obtain a carbon nanotube film.

In step (a), the plurality of carbon nanotubes is, beneficially, formed by the substeps of: (a1) providing a substantially flat and smooth substrate; (a2) forming a catalyst layer on the substrate; (a3) annealing the substrate with the catalyst layer in air at a temperature in the approximate range from 700° C. to 900° C. for about 30 to 90 minutes; (a4) heating the substrate with the catalyst layer to a temperature in the approximate range from 500° C. to 740° C. in a furnace with a protective gas therein; (a5) supplying a carbon source gas to the furnace for about 5 to 30 minutes and growing a super-aligned array of carbon nanotubes on the substrate; (a6) separating the array of carbon nanotubes from the substrate to obtain the raw material of carbon nanotubes.

In step (a1), the substrate can, beneficially, be a P-type silicon wafer, an N-type silicon wafer, or a silicon wafer with a film of silicon dioxide thereon. Preferably, a 4-inch P-type silicon wafer is used as the substrate.

In step (a2), the catalyst can, advantageously, be made of iron (Fe), cobalt (Co), nickel (Ni), or any alloy thereof.

In step (a4), the protective gas can, beneficially, be made up of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can, opportunely, have a height above 100 microns and include a plurality of carbon nanotubes parallel to each other and approximately perpendicular to the substrate. Because the length of the carbon nanotubes is very long, portions of the carbon nanotubes are bundled together. Moreover, the super-aligned array of carbon nanotubes formed under the above conditions is essentially free of impurities such as carbonaceous or residual catalyst particles. The carbon nanotubes in the super-aligned array are closely packed together by the van der Waals attractive force.

In step (a6), the array of carbon nanotube is scraped from the substrate by a knife or other similar devices to obtain the raw material of carbon nanotubes. Such a raw material is, to a certain degree, able to maintain the bundled state of the carbon nanotubes.

Further, the solvent is selected from the group consisting of solution containing metallic ions, metal nano-particles, and metal complex ions. The metal is selected from the group consisting of gold (Au), silver (Ag), copper (Cu), aluminum (Al), and indium (In). In the embodiment, silver ammonia solution is used to act as the solvent. The specific preparation of the silver ammonia solution is describe as follows. Firstly, a measure of ammonia water is gradually added to a solution of silver nitrate to form a precipitate of silver hydroxide. At the same time, agitating the solution of silver nitrate is also needed. Secondly, another measure of ammonia water is dropped, until the precipitation fully dissolves in the solution. As such, silver ammonia complex ions ($Ag(NH3)_2^+$) are created in the solution.

The process of flocculating is selected from the group consisting of ultrasonic dispersion and agitating. Quite usefully, in the present embodiment, ultrasonic dispersion is used to flocculate the solvent containing the carbon nanotubes for about 10-30 minutes. Due to the carbon nanotubes in the solvent having a large specific surface area and the bundled carbon nanotubes having a large van der Waals attractive force, the flocculated and bundled carbon nanotubes form a network structure (i.e., floccule structure).

In step (b), some reducing agents are added into the solvent to reduce the metallic ions into metallic atoms. The reducing agent is selected according to the type of the metallic ions. The reducing agent is selected from the group consisting of acetaldehyde, glucose and formaldehyde. Silver ions in the silver ammonia complex ions are attached to the carbon nanotubes by reduction action of the reducing agent. Quite usefully, in this embodiment the acetaldehyde solution is added to the solvent to reduce the silver ions therein, thereby the silver ions being attached on the outer surfaces of the carbon nanotubes. It is to be understood that the amount of the reducing agent added to the solvent is selected according to the concentration of the metallic ions. That is, when the concentration of metallic ions is high, the amount of reducing agent added is also high.

Figure 2:
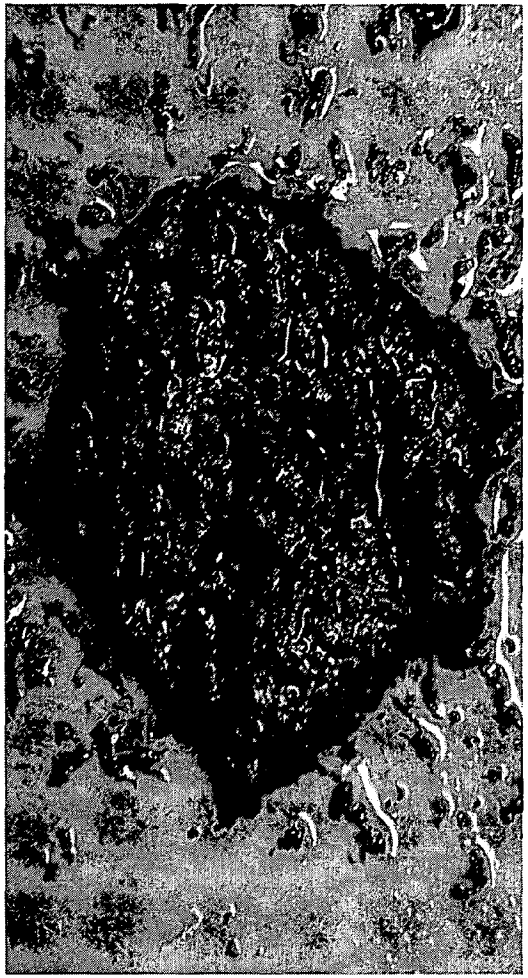
FIG. 2 shows a Scanning Electron Microscope (SEM) image of a floccule structure of carbon nanotubes formed by the method of FIG. 1.

Referring to FIG. 2, an SEM image of the floccule structure of carbon nanotubes compounded with metal atoms is shown. Compared with the method of filling gaps of the carbon nanotube film directly with metal through the mechanical mixing method, the metal in the embodiment is filled by an in situ reducing method. Thus, the reduced metallic atoms, advantageously, closely bond with the carbon nanotubes and are uniformly dispersed in the floccule structure of the carbon nanotubes. That is, the reduced metallic atoms are attached on the surface and filled into gaps of the carbon nanotubes. It is to be understood that the concentration of metallic ions in the solvent is used to control the ratio of the metal compound in the floccule structure of carbon nanotubes. As such, the higher the concentration of the metallic ions, the larger the ratio of the compounded metal in the floccule structure of carbon nanotubes.

In step (c), the process of separating the carbon nanotube floccule structure from the solvent includes the substeps of: (c1) filtering out the carbon nanotube floccule structure by pouring the solvent containing the floccule structure through filter into a funnel; and (c2) drying the carbon nanotube floccule structure captured on the filter to obtain the separated carbon nanotube floccule structure. In step (c2), a time of standing and drying can be selected according to practical needs.

In step (c), the process of shaping includes the substeps of: (c3) putting the separated carbon nanotube floccule structure into a container (not shown), and spreading the carbon nanotube floccule structure to form a predetermined structure; (c4) pressing the spread carbon nanotube floccule structure with a certain pressure to yield a desired shape; and (c5) removing the residual solvent contained in the spread floccule structure to form the carbon nanotube film.

It is to be understood that the size of the spread floccule structure is, advantageously, used to control a thickness and a surface density of the carbon nanotube film. As such, the larger the area of the floccule structure, the less the thickness and density of the carbon nanotube film. In the embodiment, the thickness of the carbon nanotube film is in the approximate range from 1 micron to 2 millimeters.

Further, the step (c) can be accomplished by a process of pumping and filtering to obtain the carbon nanotube film. The pumping filtration process includes the substeps of: (c1') providing a microporous membrane and an air-pumping funnel; (c2') filtering out the solvent from the flocculated carbon nanotubes through the microporous membrane using the air-pumping funnel; and (c3') air-pumping and drying the flocculated carbon nanotubes attached on the microporous membrane.

The microporous membrane has a smooth surface. And the aperture/diameters of micropores in the membrane are about 0.22 microns. The pumping filtration can exert air pressure on the floccule structure, thus, forming a uniform carbon nanotube film. Moreover, due to the microporous membrane having a smooth surface, the carbon nanotube film can, beneficially, be easily separated.

Figure 3:
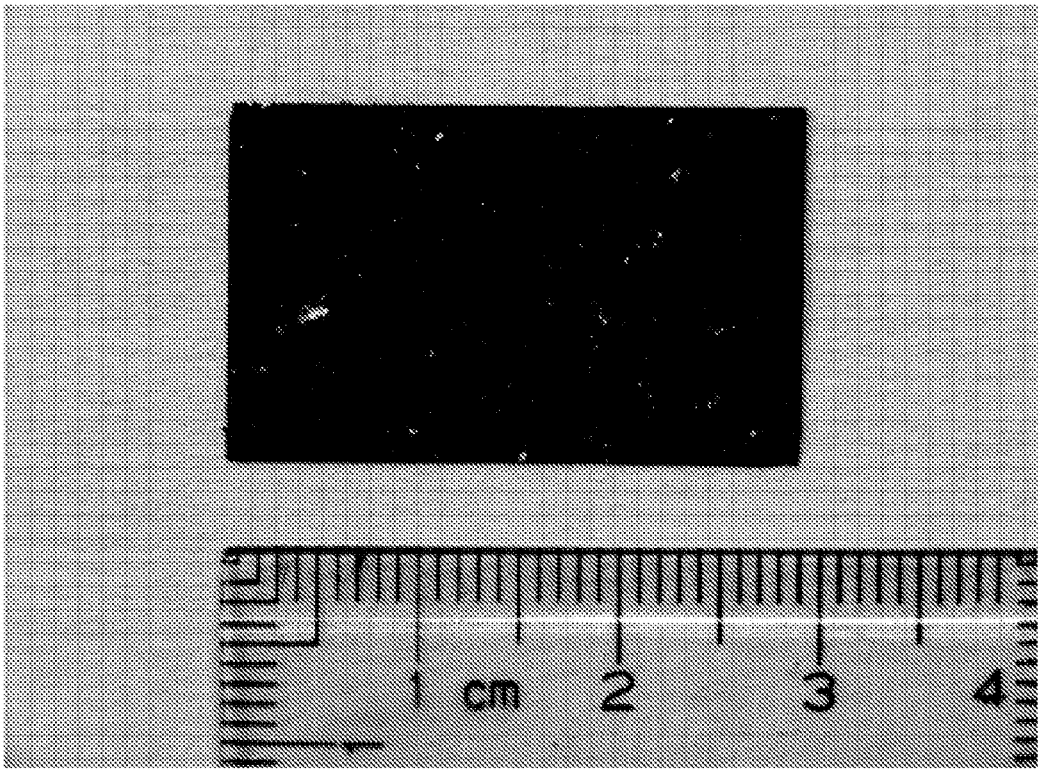
FIG. 3 shows a Scanning Electron Microscope (SEM) image of the carbon nanotube film formed by the method of FIG. 1 wherein the carbon nanotube film has a predetermined shape.

Referring to FIG. 3, bundling of the carbon nanotubes in the carbon nanotube film provides strength to the carbon nanotube film. Therefore, the carbon nanotube film is, advantageously, easy to be folded and/or bended into arbitrary shapes without rupture.

The carbon nanotube film produced by the method has the following virtues. Firstly, the metal atoms in the embodiment are compounded with/added to the carbon nanotubes by an in situ reducing method. Thus, the reduced metallic atoms, advantageously, closely bond with the carbon nanotubes and are uniformly dispersed in the floccule structure of carbon nanotubes. As such, the ratio of the metallic atoms compounded with the carbon nanotubes is controllable. Secondly, because of flocculating, the carbon nanotubes are bundled together by van der Walls attractive force to form a network structure/floccule structure. Thus, the carbon nanotube film is very tough. Thirdly, the carbon nanotube film is very simply and efficiently produced by the method. A result of the production process of the method, is that the thickness and surface density of the carbon nanotube film are controllable.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for making a carbon nanotube film, the method consisting of:

(a) adding a plurality of raw carbon nanotubes into a solvent containing metallic ions, and flocculating the plurality of raw carbon nanotubes to get a floccule structure with the metallic ions dispersed in the solvent, the carbon nanotubes of the floccule structure are bundled together by van der Waals attractive force to form a network structure in the solvent, wherein portions of the plurality of raw carbon nanotubes are bundled together;

(b) reducing the metallic ions into metallic atoms, thereby the metallic atoms being attached onto outer surfaces of the carbon nanotubes to form a floccule structure of carbon nanotubes compounded with metal atoms;

(c) separating the floccule structure compounded with metal atoms from the solvent; and (d) shaping the floccule structure compounded with metal atoms to obtain the carbon nanotube film.

2. The method as claimed in claim 1, wherein in step (a), the plurality of raw carbon nanotubes are obtained by providing an array of carbon nanotubes formed on a substrate and separating the array of carbon nanotubes from the substrate.

3. The method as claimed in claim 1, wherein in step (a), the process of flocculating the plurality of raw carbon nanotubes is selected from the group consisting of ultrasonic dispersion of the plurality of raw carbon nanotubes and agitating the plurality of raw carbon nanotubes.

4. The method as claimed in claim 1, wherein the metallic ions are selected from the group consisting of gold ions, silver ions, copper ions, aluminum ions, and indium ions.

5. The method as claimed in claim 4, wherein the solvent containing the metallic ions is a silver ammonia solution.

6. The method as claimed in claim 1, wherein in step (b), the metallic ions are reduced to metallic atoms using at least one reducing agent selected from the group consisting of acetaldehyde, glucose and formaldehyde.

7. The method as claimed in claim 1, wherein in step (c), the process of separating comprises the substeps of:

(c1) pouring the solvent containing the floccule structure through a filter into a funnel; and (c2) drying the floccule structure captured on the filter to obtain the separated floccule structure of carbon nanotubes.

8. The method as claimed in claim 7, wherein in step (d), the process of shaping comprises the substeps of:

(d1) putting the separated floccule structure into a container, and spreading the floccule structure to form a predetermined structure;

(d2) pressing the spread floccule structure to yield a desired shape; and (d3) drying the spread floccule structure to remove any residual solvent or volatilizing the residual solvent to form a carbon nanotube film.

9. The method as claimed in claim 1, wherein a thickness of the carbon nanotube film is in the range from 1 micron to 2 millimeters.

10. A method for making a carbon nanotube film, the method consisting of:

(a) adding a plurality of raw carbon nanotubes into a solvent containing metallic ions, and flocculating the plurality of raw carbon nanotubes to get a floccule structure with the metallic ions dispersed in the solvent, the carbon nanotubes of the floccule structure are bundled together by van der Waals attractive force to form a network structure in the solvent, wherein portions of the plurality of raw carbon nanotubes are bundled together;

(b) reducing the metallic ions into metallic atoms, thereby the metallic atoms being attached onto outer surfaces of the carbon nanotubes to form a floccule structure of carbon nanotubes compounded with metal atoms; and (c) filtering the floccule structure of carbon nanotubes compounded with metal atoms from the solvent by a pumping filtration process to obtain the carbon nanotube film.

11. The method as claimed in claim 10, wherein the process of filtering comprises the substeps of:

providing a microporous membrane and an air-pumping funnel;

filtering out the solvent from the floccule structure of carbon nanotubes compounded with metal atoms through the microporous membrane using the air-pumping funnel; and air-pumping and drying the floccule structure of carbon nanotubes compounded with metal atoms attached on the microporous membrane.

* * * * *